United States Patent [19]

Mesun et al.

[11] Patent Number: 4,710,987

[45] Date of Patent: Dec. 8, 1987

[54] TOILET RIM WATER DISTRIBUTOR

[75] Inventors: Randy O. Mesun, Sheboygan; Frank Schobert, Plymouth, both of Wis.

[73] Assignee: Kohler Co., Kohler, Wis.

[21] Appl. No.: 53,512

[22] Filed: May 15, 1987

Related U.S. Application Data

[63] Continuation of Ser. No. 791,943, Oct. 28, 1985, abandoned.

[51] Int. Cl.[4] ..... E03D 5/00

[52] U.S. Cl. ..... 4/420

[58] Field of Search ..... 4/300.3, 311, 420–429, 4/300

[56] References Cited

U.S. PATENT DOCUMENTS

| | | | |
|---|---|---|---|
| 158,896 | 1/1975 | Brinckerhoff . | |
| 535,062 | 3/1895 | Kelly . | |
| 927,132 | 7/1909 | Duenwald . | |
| 1,037,110 | 8/1912 | Beswick . | |
| 1,142,249 | 6/1915 | Griffiths . | |
| 2,993,213 | 8/1961 | Carroll | 4/181 |
| 3,212,106 | 10/1965 | Noel | 4/69 |
| 3,411,162 | 11/1968 | Palmer | 4/89 |
| 3,538,518 | 10/1970 | Helke et al. | 4/10 |
| 4,006,497 | 2/1977 | Mollerstedt | 4/1 |
| 4,041,554 | 8/1977 | Gregory et al. | 4/10 |
| 4,106,131 | 8/1978 | Delker | 4/1 |
| 4,234,975 | 11/1980 | Revels | 4/300 |
| 4,559,650 | 12/1985 | Pruckner | 4/420 |

*Primary Examiner*—Charles E. Phillips

*Attorney, Agent, or Firm*—Quarles & Brady

[57] ABSTRACT

A water distributor for use in an open flush rim of a toilet bowl is disclosed. In one embodiment, there is a flexible tube portion forming a compressible portion and a guide portion extending out from the outer wall of the tube portion which has a plurality of downwardly directed water channels. The guide and tube portions are constructed so as to be able to retain the distributor in the flush rim of the toilet bowl in a compressive manner and without projections in the flush rim.

4 Claims, 5 Drawing Figures

FIG. 1
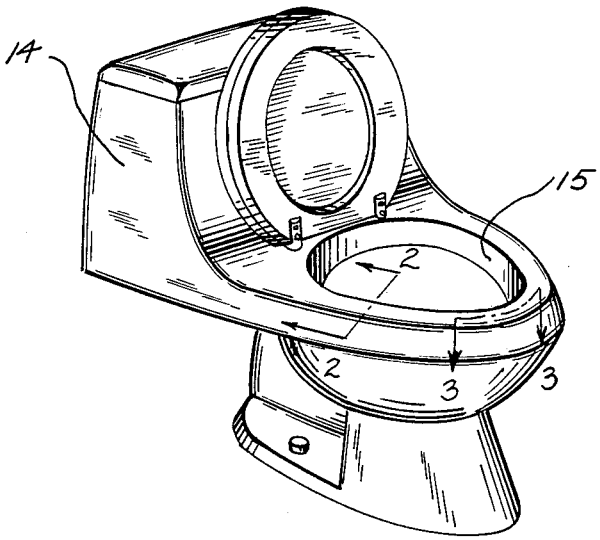
FIG. 2
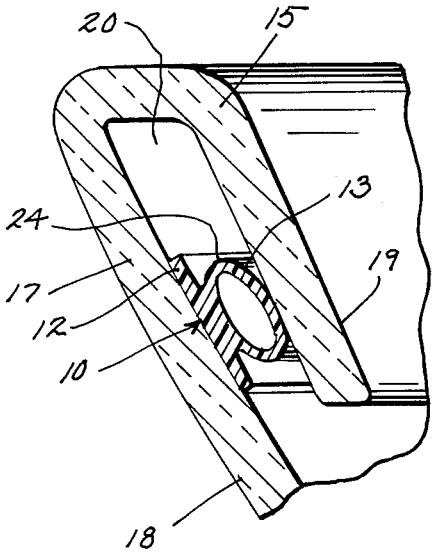
FIG. 3
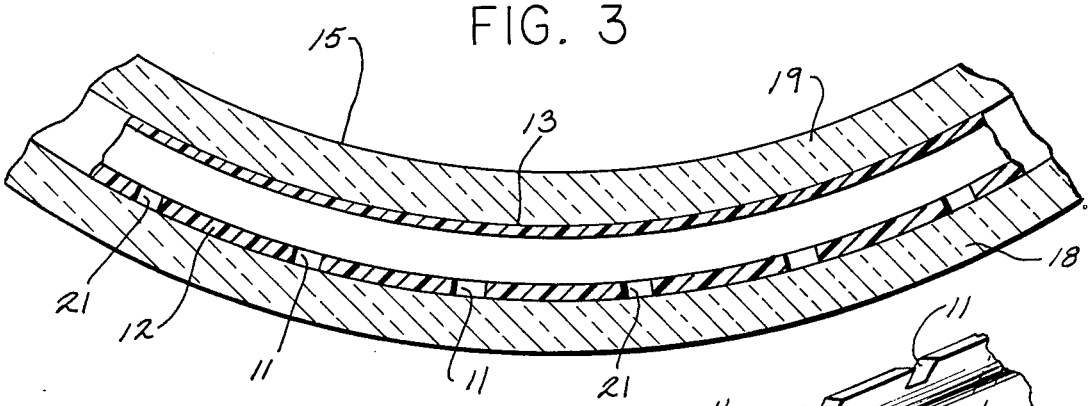
FIG. 4
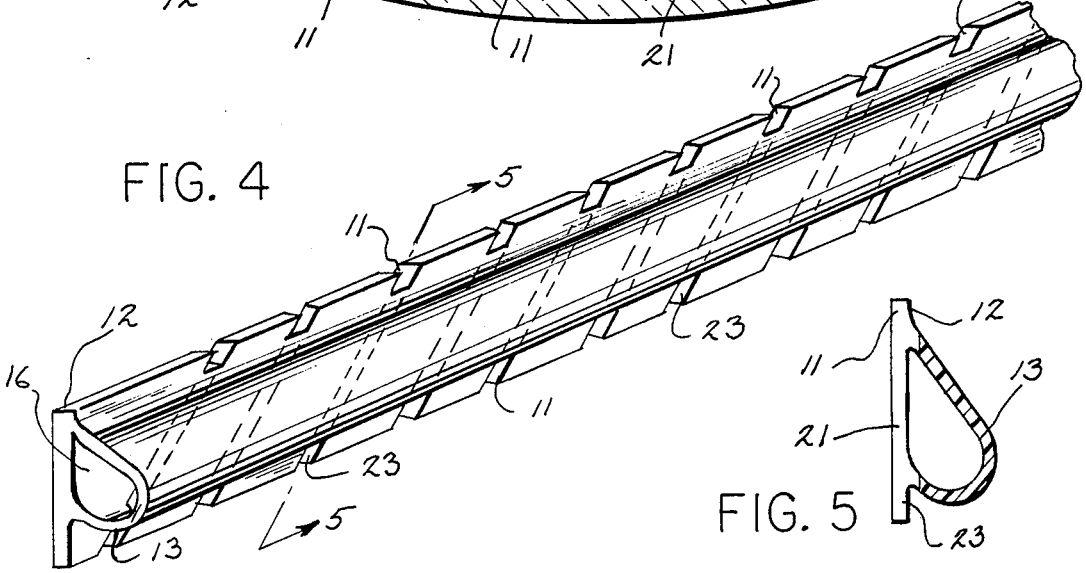
FIG. 5

TOILET RIM WATER DISTRIBUTOR

This application continuation of application Ser. No. 791,943, filed 10/28/85, now abandoned.

BACKGROUND OF THE INVENTION

A. Field Of The Invention

This invention relates to a water distributor for use in a toilet bowl. The distributor is especially suited for use in a downwardly open flush rim.

B. Description Of The Art

It is known in the prior art to provide various types of water distributors in conjunction with downwardly open toilet flush rims. These distributors insure relatively uniform cleaning around the bowl, without requiring complex molding of the rim and without the problems closed rims sometimes have. In U.S. Pat. No. 158,896, a perforated pipe was used for this purpose. In U.S. Pat. No. 3,212,106, a plastic tubing with regular perforations was held in place in the rim by an interference fit. In another design, a strip of flexible material was used for water distribution purposes in the flush rim of U.S. Pat. No. 4,106,131.

However, prior art water distributors often required some type of special projection formed in the rim to secure the distributor in the rim, or required the use of special tools, or required excessive installation time. This added to the cost of molding the toilet and installing the distributor. In some cases, there was even chipping and breakage of the projections.

Another problem was that for water conservation purposes, it was desired to direct the water towards the inner wall of the bowl in a somewhat horizontal direction (to improve cleaning effectiveness). Thus, the art attempted to jerry-rig constructions such as that shown in U.S. Pat. No. 4,234,975 in which a conventional closed rim was used, but a separate sub-structure was required for horizontally directing the water.

Thus, it can be seen that a need has existed for an improved water distributor for an open-type flush rim.

SUMMARY OF THE INVENTION

The present invention relates to a flush rim for a toilet bowl of the type having a fixed top wall as well as fixed and at least partially downwardly directed sidewalls. A removable water distributor is mounted under the top wall and between the sidewalls. The improved flush rim has the inner surfaces of the sidewalls devoid of support projections for the water distributor. The distributor is sufficiently compressible to be normally held in place under the top wall and between the side walls by the compressive force of the distributor against the side walls. A plurality of at least partially downwardly directed water channels are formed in the water distributor. When water is introduced into the rim, it will flow in a conduit provided by the top and side walls of the rim and the upper surface of the distributor. It will then pass through the channels to a lower portion of the toilet. Preferably the side walls of the flush rim converge downwardly and the distributor is formed in part with a tubular structure, with a strip adjacent to the tube in which the water channels are formed.

In another embodiment, there is a water distributor for use in an open flush rim of a toilet bowl. It includes a flexible tube portion and a guide portion extending out from the outer wall of the tube portion. The guide portion has a plurality of at least somewhat downwardly directable water channels. The guide and tube portions are constructed and arranged so as to be able to retain the distributor in the flush rim of the toilet bowl in a compressive manner with the guide portion being adapted to engage one wall surface of the rim and the tube portion being adapted to engage another wall surface.

In still another embodiment, there is a flexible tube portion having at least one inlet and a plurality of spaced radial outlets. A guide portion extends out from the outer wall of the tube portion and has a plurality of at least somewhat downwardly directable water channels. The radial outlets are in communication with these water cannels. The guide and tube portions are constructed and arranged so as to be able to retain the distributor in the flush rim of the toilet bowl in a compressive manner, with the guide portion adapted to engage one wall surface of the rim and the tube portion adapted to engage another wall surface of the flush rim.

Preferably, the guide portion is a substantially flat strip that is attached in a substantially tangential manner to the tube portion, and the water channels extend completely through the strip in the radial direction so that one wall of the flush rim can form end walls for the water channels. The water channels can be disposed in an angular manner in a generally horizontal flush rim so as to impart a horizontal force component to the water passing through. A preferred angle is approximately 45° with respect to the longitudinal axis of the tube portion. In an especially preferred form, the tube and guide portions can be formed together in a one-piece construction.

The tube portion is suitable to distribute the water from the toilet tank. When the water pressure is sufficient, water will be forced over the tubular portion (or if desired through the tubular portion and out radial holes formed at regularly spaced locations along the tube) and then down towards the toilet bowl inner wall. The guide structure forces the water to flow in a partially horizontal direction, and permits the water to flow directly against the bowl inner wall. The horizontal force component that the guide gives the water enhances cleaning and thus lowers the amount of water needed.

The flexible nature of the water distributor and its compressibility are sufficient to hold it inside the rim. Thus no additional projections formed on the inside of the rim are needed. The distributor can be inserted under the rim simply by pushing it up from underneath.

The objects of the invention therefor include:

Providing a water distributor of the above kind which can be retained in position without the use of special projections formed in the rim;

Providing a water distributor of the above kind which is of one piece construction;

Providing a water distributor of the above kind which provides a horizontal force component to the water directly along the bowl interior;

Providing a water distributor of the above kind which can be inserted and removed without special tools or skills;

Providing a water distributor of the above kind which is inexpensive to produce and install; and Providing a flush rim having such a water distributor.

BRIEF DESCRIPTION OF THE DRAWINGS

A better understanding of the preferred embodiments of the invention will be had with reference to the accompanying drawings:

FIG. 1 is a top perspective view of a toilet having a downwardly open flush rim;

FIG. 2 is a cross-sectional view taken along line 2—2 in FIG. 1, showing of one embodiment of a water distributor of the present invention installed in the toilet of FIG. 1;

FIG. 3 is a fragmentary sectional view taken along line 3—3 of FIG. 1;

FIG. 4 is a top perspective view of a prepared configuration of a water distributor such as shown in FIG. 2 apart from the toilet rim; and FIG. 5 is a cross-sectional view taken along line 5—5 of FIG. 4.

DESCRIPTION OF THE PREFERRED EMBODIMENTS

A water distributor 10 is best shown in FIG. 4. It is preferrably formed from an extrudable vinyl plastic such as Geon (obtained from B.F. Goodrich, Co.). After the extrusion, slits 11 are cut through the strip 12 preferrably at an angle of 45° with respect to the longitudinal axis of the integral tube portion 13.

The distributor 10 can be used in conjunction with a toilet 14 having a downwardly open flush rim 15. Water is carried from the toilet tank to the flush rim by suitable piping. At least one end of the outlet of the piping is positioned above the top surface 24 of the tube portion 13 or, alternatively, the piping outlet may be attached to a longitudinal end 16 of the distributor 10.

As best seen in FIG. 2, the flush rim 15 has an outer side wall 17 which melds into the inner lower wall of the toilet bowl 18. There is also a downwardly directed inner rim side wall 19. Opposed walls 18 and 19 converge slightly to form a conduit 20.

The linear water distributor is flexible so as to be able to bend to conform to the round shape of the rim, and the tube portion 13 is inwardly compressible (compare FIG. 2 and FIG. 4) so that the distributor can be squeezed between walls 18 and 19 into the pocket 20. Once installed, then strip 12 abuts against the wall 18, and the tube 13 abuts against the wall 19. The configuration of distributor as shown in FIGS. 4 and 5 is preferred as it assists in the insertion into the pocket 20. As indicated in FIG. 2 the distributor can be of a more oval configuration.

From FIG. 5, one can see that the tube portion 13 has a series of outlets 21 on its raidal periphery. Strip 12 is for guiding purposes. It extends out from the outer wall of the tube portion 13. Slits 11 form a plurality of partially downwardly directed water channels 23.

As best seen in FIG. 5, the radial openings 21 are in direct communication with the water channels 23 so as to form a continuous flow path. The strip 12, in this view, appears to be almost tangential to the tube.

In an especially preferred form, the water channels 23 extend completely through the strip 12 in the radial direction, so that one wall 17 of the flush rim 15 can form end walls for the channels (see FIGS. 2 and 3).

The present invention can easily be assembled in the rim. One simply inserts the distributor 10 under the rim, and it holds itself in place. No special tools are required for this purpose (although to expedite matters further, one could use a flat-bladed tool to push the distributor up into the rim). The distributor can be easily removed for replacement. A pointed tool can pierce into the tubular portion 13, and one can then exert a downward pressure.

When water is introduced it can travel along the upper portion 24 of the tube 13 until it reaches a pressure and level where it travels radially outward towards the wall 18. The water will then travel down the guide slits 23 against the inner side 18 of the bowl. If desired, water could instead be introduced through inlet 16 into the inside of tube 13. In such case water would travel therethrough and out through the radial outlets 21 and into slits 23.

Tube 13 is the preferred form of a compressible portion for compressive positioning in the rim 15. If desired the tube 13 could instead be a solid mass of compressible material and function in the previously described manner with the strip 12 and slits 23.

The slits 11 have been illustrated as being at a 45° angle with respect to the longitudinal axis of the tubular member. However, this angle is not critical. Other angles which provide a horizontal force to the water may assist in cleaning. Further, while the strip on guide 12 has been shown as being installed against the wall 18, the distributor could be flipped upside down so that the guide portion 12 is against the wall 19.

Moreover, slits 23 need not pass all the way through strip 12 in a radially outward direction so as to divide the strip 12 into separate pieces. Instead, they could be formed entirely inside the guide portion. Also, while FIG. 2 shows that the side walls 18 and 19 of the rim converge, this would not be absolutely necessary and it is only part of the preferred embodiment. Further, while flexible vinyl plastic is the preferred material for forming the distributor, other flexible materials might also prove suitable.

Inlet 16 is shown as being an axial inlet. It might instead be replaced with a radial inlet at some point along the line or more than one inlet could be used.

Thus, while the preferred embodiments have been described above, it should be readily apparent to those skilled in the art that a number of other modifications and changes can be made to these embodiments without departing from the invention. Therefore, it is intended that the scope of the invention should not be limited solely by the description of the preferred embodiments. Rather, the claims should be looked to determine the scope of the invention.

We claim:

1. A water distributor suitable for use in a downwardly open flush rim of a toilet bowl, the rim being of the type having a fixed top wall and fixed at least partially downwardly directed sidewalls with one side wall having a flushing water inlet, said sidewalls being of the type devoid of support projections or grooves for the distributor, the distributor being freely removable from said rim, comprising:

a flexible compressible tube portion positionable under the top wall below said inlet to follow the bowl periphery with an upper surface suitable to support water flow in the rim above and outside of the tube, the tubular portion capable of being deformed to provide compressive retention of said distributor in said rim without the need for an adhesive;

a flexible generally flat planar side surface guide portion tangentially connected to the tube portion and extending above and below said tangential connection and positionable along one of the rim sidewalls, and said guide portion having a plurality of at least somewhat downwardly directable water channels, said water channels extending through said planar portion to permit communication between a space above the distributor water support surface in the rim and the space below the distributor in the bowl, at least one of which extends in a manner to be in open communication with the rim sidewall such that the rim sidewall can form a sidewall for the channel.

2. The distributor of claim 1, wherein an opening extends through a sidewall of the tube portion in fluid communication with a water channel.

3. The water distributor of claim 1, wherein the water channels can be disposed in an angular manner along the rim sidewalls so as to impart a horizontal force component to water passing therethrough.

4. The water distributor of claim 1, wherein said tube and guide portions are formed together in a one-piece construction.

* * * * *